US010480220B2

(12) United States Patent
Weichsel et al.

(10) Patent No.: US 10,480,220 B2
(45) Date of Patent: Nov. 19, 2019

(54) BOWDEN CABLE BEARING FOR A MOTOR VEHICLE LOCK

(71) Applicant: Kiekert Aktiengesellschaft, Heiligenhaus (DE)

(72) Inventors: Ulrich Weichsel, Duisburg (DE); Omer Inan, Dorsten (DE); Heiko Hemmer, Essen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 259 days.

(21) Appl. No.: 14/893,986

(22) PCT Filed: May 28, 2014

(86) PCT No.: PCT/DE2014/000266
§ 371 (c)(1),
(2) Date: Apr. 4, 2016

(87) PCT Pub. No.: WO2014/190965
PCT Pub. Date: Dec. 4, 2014

(65) Prior Publication Data

US 2016/0208521 A1 Jul. 21, 2016

(30) Foreign Application Priority Data

May 31, 2013 (DE) ..... 10 2013 009 225

(51) Int. Cl.
*E05B 79/20* (2014.01)
*E05B 85/02* (2014.01)
*E05B 79/08* (2014.01)

(52) U.S. Cl.
CPC ..... *E05B 79/20* (2013.01); *E05B 79/08* (2013.01); *E05B 85/02* (2013.01)

(58) Field of Classification Search
CPC . E05C 9/20; E05C 9/22; E05B 53/003; E05B 53/005; E05B 79/20; E05B 79/22;
(Continued)

(56) References Cited

U.S. PATENT DOCUMENTS 4,298,223 A * 11/1981 Raffelsiefer ..... E05B 85/26 292/216
4,456,289 A 6/1984 Badiali
(Continued)

FOREIGN PATENT DOCUMENTS

DE 198 10 666 C1 9/1999
DE 202 10 249 U1 3/2003
(Continued)

OTHER PUBLICATIONS

Machine Translation of DE102005059833A1 by Lexis Nexis Total Patent on Apr. 1, 2016.
(Continued)

*Primary Examiner* — Christine M Mills
(74) *Attorney, Agent, or Firm* — Woodard, Emhardt, Henry, Reeves & Wagner, LLP

(57) ABSTRACT

A lock in a motor vehicle, in particular a side-door lock, comprising a Bowden cable, a receiving element in the lock for the Bowden cable, a counter-bearing, a lock case and a lock housing, the counter-bearing being designed as a separate receiving element for the Bowden cable.

18 Claims, 2 Drawing Sheets

(58) Field of Classification Search

CPC ..... E05B 79/08; E05B 85/02; F16C 1/102; F16C 1/103; Y10T 74/2045; Y10T 74/20462; Y10T 292/03; Y10T 292/1047; Y10T 292/0855; Y10T 292/08; Y10T 292/0899; Y10T 292/0931; Y10T 292/094; Y10T 292/0992; Y10T 292/1017; Y10T 292/1057; Y10T 292/1069; Y10S 292/23; Y10S 292/53; Y10S 292/54; Y10S 292/64

USPC ..... 292/1, 216, DIG. 23, DIG. 53, DIG. 54, 292/DIG. 64, 38, 50, 28, 84, 125, 133, 292/171, 141, 225, 235; 74/502.4, 502.6

See application file for complete search history.

(56) References Cited

U.S. PATENT DOCUMENTS

| | | | | |
|---|---|---|---|---|
| 4,478,441 | A | 10/1984 | Fiordellisi et al. | |
| 4,861,081 | A * | 8/1989 | Satoh | E05B 79/12 292/336.3 |
| 5,350,206 | A * | 9/1994 | Akahori | E05B 63/0056 292/336.3 |
| 6,178,845 | B1 * | 1/2001 | Gutschner | F16C 1/105 74/501.5 R |
| 6,369,395 | B1 | 4/2002 | Roessler | |
| 6,971,816 | B2 * | 12/2005 | Miyagawa | F16C 1/105 248/74.1 |
| 7,387,282 | B2 * | 6/2008 | Kovac | B60R 16/0215 248/55 |
| 8,366,059 | B2 * | 2/2013 | Fannon | E05B 79/20 24/16 PB |
| 8,408,611 | B2 * | 4/2013 | Takagai | E05B 77/04 292/336.3 |
| 9,290,971 | B2 * | 3/2016 | Amagai | E05B 79/20 |
| 9,540,854 | B2 * | 1/2017 | Graute | E05B 77/34 |
| 2004/0144142 | A1 * | 7/2004 | Dimig | E05B 79/04 70/208 |
| 2005/0067539 | A1 * | 3/2005 | Fannon | F16C 1/105 248/65 |
| 2007/0273163 | A1 * | 11/2007 | Gurtatowski | E05B 85/12 292/336.3 |
| 2010/0236305 | A1 * | 9/2010 | Beck | E05B 77/10 70/237 |
| 2015/0145262 | A1 * | 5/2015 | Gotzen | E05B 77/10 292/194 |
| 2015/0247347 | A1 * | 9/2015 | Suzumura | E05B 79/20 292/2 |

FOREIGN PATENT DOCUMENTS

| | | | | |
|---|---|---|---|---|
| DE | 20210249 | U1 | 3/2003 | |
| DE | 20201149 | U1 | 7/2003 | |
| DE | 10300640 | A1 | 8/2003 | |
| DE | 103 34 223 | A1 | 2/2005 | |
| DE | 20 2005 020 453 | U1 | 4/2006 | |
| DE | 102005059833 | A1 | 8/2006 | |
| DE | 10334223 | B4 | 7/2007 | |
| DE | 102012018093 | A1 | 3/2014 | |
| FR | 2984938 | A1 * | 6/2013 | E05B 85/02 |
| GB | 2263724 | A | 8/1993 | |
| JP | 2005225416 | A | 8/2005 | |
| WO | WO-2015136775 | A1 * | 9/2015 | E05B 79/20 |

OTHER PUBLICATIONS

Machine Translation of DE102012018093A1 by Lexis Nexis Total Patent on Apr. 1, 2016.

Machine Translation of DE10334223B4 by Lexis Nexis Total Patent on Apr. 1, 2016.

Machine Translation of DE20201149U1 by Lexis Nexis Total Patent on Apr. 1, 2016.

Machine Translation of DE20210249U1 by Lexis Nexis Total Patent on Apr. 1, 2016.

Machine Translation of JP2005225416A by Lexis Nexis Total Patent on Apr. 1, 2016.

First Office Action and English translation issued in related CN201480042879.4 dated Nov. 2, 2016.

German Office Action issued in related DE10 2013 009 225.6 dated Mar. 12, 2014.

Machine translation of DE10300640A1 by European Patent Office Patent Translate on Apr. 30, 2019 (pp. 15).

Machine translation of DE10334223A1 by European Patent Office Patent Translate on Apr. 30, 2019 (pp. 13).

Machine translation of DE202005020453U1 by European Patent Office Patent Translate on Apr. 30, 2019 (pp. 15).

Machine translation of DE20210249U1 by European Patent Office Patent Translate on Apr. 30, 2019 (pp. 23).

Second Office Action and English translation issued in related CN201480042879.4 dated Jul. 3, 2017.

* cited by examiner

BOWDEN CABLE BEARING FOR A MOTOR VEHICLE LOCK

BACKGROUND

The invention relates to a latch in a motor vehicle, in particular, a side-door latch, comprising a Bowden cable, a receiving means for the Bowden cable inside the latch, a counter-bearing, a frame box and a lock housing. The latch can contain a closing means.

It is known that vehicles and predominantly premium-class vehicles are equipped with side door latches with closing aids. Such closing aids can contain levers, moved by a Bowden cable in order to, for instance, actuate a rotary latch. As a result, a side door can, for instance, be electrically actuated to move from the pre-ratchet position into its main ratchet position. In order to ensure a reliable functioning of this technology a receiving means for the Bowden cable is required in the latch.

DE 202 10 249 U1 discloses that the bearings accommodating the Bowden cables can be connected to the lock housing to form a single unit or, in other words, that an angled panel of the lock housing forms the bearing and, at the same time, part of the latch of a motor hood.

Patent DE 10 2012 018 093 also discloses that in some cases separate receiving elements with a Bowden cable bearing are used in motor vehicle latches. The arrangement actually consists of a contour serving as a bearing in the latch. It contains a circular opening for accommodating a Bowden cable, with this point being reinforced by struts. The Bowden cable is also fixed by a combination of clamps. The lock housing and the clamps are made from plastic.

DE 103 34 223 B4 describes a separate receiving element for a Bowden cable bearing in a motor vehicle door latch. The element is made of plastic and contains a formed strut, providing a circular bearing point for the Bowden cable. The end of the element assembly contains a guide for attaching the receiving element on to the lock housing.

The known state of the art has generally proven to be successful as regards the receiving element with a bearing for a Bowden cable. The connection does, however, on one hand require the receiving element to have a complex geometry and the design of the lock housing to be adapted, on the other hand, to the dynamic movements. This is, however, a disadvantage as according to the latest developments, motor vehicle door latches and thus their lock housing tend to be standardized.

SUMMARY

The invention is based on the technical problem of further developing a lock housing for a motor vehicle door latch of the described design in such a way that it allows a broad standardization, so that different receiving elements can be used for accommodating the Bowden cable without the lock housing having to be changed.

In order to solve this problem, a latch has been developed for a motor vehicle and, in particular, a, side-door latch, containing a Bowden cable, a receiving element for the Bowden cable in the latch, a counter-bearing, a frame box and a lock housing, with the counter-bearing being designed as a separate receiving element for a Bowden cable. The advantage of the latch according to the invention is its considerable flexibility during assembly or production, as the separate receiving element for the Bowden cable can be replaced. Replaceable means in this case that, being a separate component, the receiving element can be adapted to individual requirements. Different forces may, for instance, be required when closing a door, as a closing force does, for instance, depend on the size of the side door. During closing, the door is pulled against the door seal. For large doors and consequently a large area, considerable forces may be required. Depending on the force required, the design of the separate receiving element can differ and can be inserted in a latch. The receiving element can thus be adapted to the specific requirements of the latch and/or of the motor vehicle.

The receiving element allows, in any case, flexible adjustment of the lock housing to the Bowden cables and without the lock housing having to be replaced. Apart from the receiving element being adaptable to the specific motor vehicle characteristics, the separate receiving element provides another advantage. The receiving element can be adapted to different means used for actuating the latch. This allows the use of different Bowden cables made by, for instance, different manufacturers, so that the latch containing a separate receiving element can be easily adapted to these requirements. This enhances standardization.

The Bowden cable of the latch is able to transmit considerable forces and can be a part of a closing means with, for instance, the closing means being able to act on the rotary latch by means of a connection to the lever in the latch.

In another embodiment of the invention, the receiving element protrudes out of a surface of the lock housing. The receiving element protruding from the surface facilitates assembly as the receiving element can be easily gripped and a Bowden cable can be easily installed in the protruding part. Protruding from the surface means that at least one part of the Bowden cable is installed on a surface of the latch or of the lock housing. The lock housing can contain several surfaces.

In a preferred embodiment, the receiving element is arranged in the Bowden cable with at least one guide formed on the lock housing. A guide can, for instance, prevent kinking of the Bowden cable. As a result of combining at least one guide and the separate receiving element, standardized guides can be connected to an individual receiving element designed as a counter-bearing. This in turn can increase adaptability to individual requirements. Also tolerances in the production of the guides can be compensated for.

In another embodiment, the receiving element is designed as a step mandrel, containing a retaining area for accommodating the Bowden cable. A step mandrel can consist of a cylindrical pin with different diameters and/or cross section areas. The cross section areas can have different shapes, such as square, rectangular, triangular, elliptical and others. The retaining area includes an opening in which the Bowden cable is installed. The Bowden cable can be accommodated and/or fixed in the retaining area without any additional adjusting elements. This arrangement is advantageous as the receiving element, is designed as a circular opening thus facilitating insertion of the Bowden cable containing a Bowden cable sheath. The retaining area contains a level surface, providing a stable support of the Bowden cable as a counter-bearing. Also the selection of the receiving element in form of a step mandrel is advantageous as the step mandrel can be easily produced by mechanical turning, milling or stamping.

The step mandrel embodiment of the receiving element also contains a supporting surface and extends into the lock housing. The bottom part of the step mandrel can also be referred to as the base. The support surface can be circular. The even arrangement of the surface of the step mandrel can thus provide the secure retention of the step mandrel. The base of the step mandrel has a cylindrical shape, facilitating the insertion of the step mandrel in the lock housing by, for instance, turning, pressing or similar method. As a result, the element is securely retained in the latch, which can contribute to the stability of the design.

In one embodiment, the support surface of the receiving element contains an installation aid. The support surface can contain a contour, recess, indentation, opening and/or raised area having, for instance, a triangular and/or trapezoidal shape. In another embodiment, the installation aids of the receiving element can be a pin and preferably a cylindrical pin or can be pin-shaped that can, for instance, be inserted in a hole in the lock housing. The installation aid allows a simplified installation of the receiving element in the latch, as the installation aid ensures the correct position of the step mandrel. This prevents the need for any additional re-adjustment or incorrect positioning of the step mandrel, guides or Bowden cable.

In a further embodiment, the receiving element contains a retaining area, in particular a circular opening and an insertion area for the Bowden cable. As already described in the above characteristic, the retaining area can contain a circular opening in which a Bowden cable can be arranged and/or fixed. The insertion area is open at the top. It contains even walls, i.e. low-friction surfaces, also containing beveling, allowing easy insertion or simplified installation of the Bowden cable. This also facilitates adjustment of the Bowden cable due to being accessible from the outside.

In a further embodiment, the receiving element can be connected to the frame box in a positive and/or non-positive and/or bonded manner. Such a connection could be a bolted, riveted or clamped connection. The receiving element is designed in such a way that it extends in the area of the frame box, allowing a connection to be produced between the receiving element and the frame box. The connection between the receiving element and the frame box can, for instance, be a positive connection, preferably a pin inserted in a hole and that can be removed again. Preferably, the hole is a blind hole preventing the pin from falling through the hole. Also a non-positive connection can be used with the receiving element preferably being welded, glued or soldered to the lock housing and/or the frame box. In another connection option, such as a non-positive connection, the receiving element can be fixed in the latch using clamps, bolts and/or wedges. The direct connection of the receiving element with the frame box through the lock housing offers the advantage of a sturdy construction as the receiving element, serving as a counter-bearing can absorb higher Bowden cable forces. The frame box can introduce these forces via the car body. Intermediate layers consisting of damping elements or buffers can also be integrated between the connected components.

In one embodiment, the connection of the receiving element to the frame box is an undetachable connection, in particular, a riveted connection. The receiving element is inserted from one side of the lock housing through a hole provided in the frame box, so that the receiving element extends through the frame box. This end is riveted to the frame box. A riveted connection is, in this case, more cost effective as it is quickly produced and requires little power and other resources for joining. The connection allows a considerable transfer of forces and also reduces the likelihood of the connection failing.

In a further embodiment, the receiving element can consist of a metal material, preferably steel or iron and/or similar alloys. The properties of such metals are generally known: amongst other things these metals offer a high stability and thermal resistance. The receiving element can thus absorb considerable impact and continuous forces. This also reduces wear of the component. Further advantageous properties can be added if the receiving element is made from aluminum. This could result in a reduction of weight. The receiving element can also be made from other materials. An alternative would be plastic resulting in light and cheaply produced injection-molded parts. Installation of a plastic, receiving element would also be easier as it can be quickly and economically connected to the lock. Other alternative materials are composites such as plastic, metal or ceramic combinations, allowing advantageous material properties such as stability, weight, adjustability and similar to be combined.

Below, the invention is explained in more detail with reference to four drawings showing only one embodiment, in which:

DETAILED DESCRIPTION OF THE DRAWINGS

Figure 1:
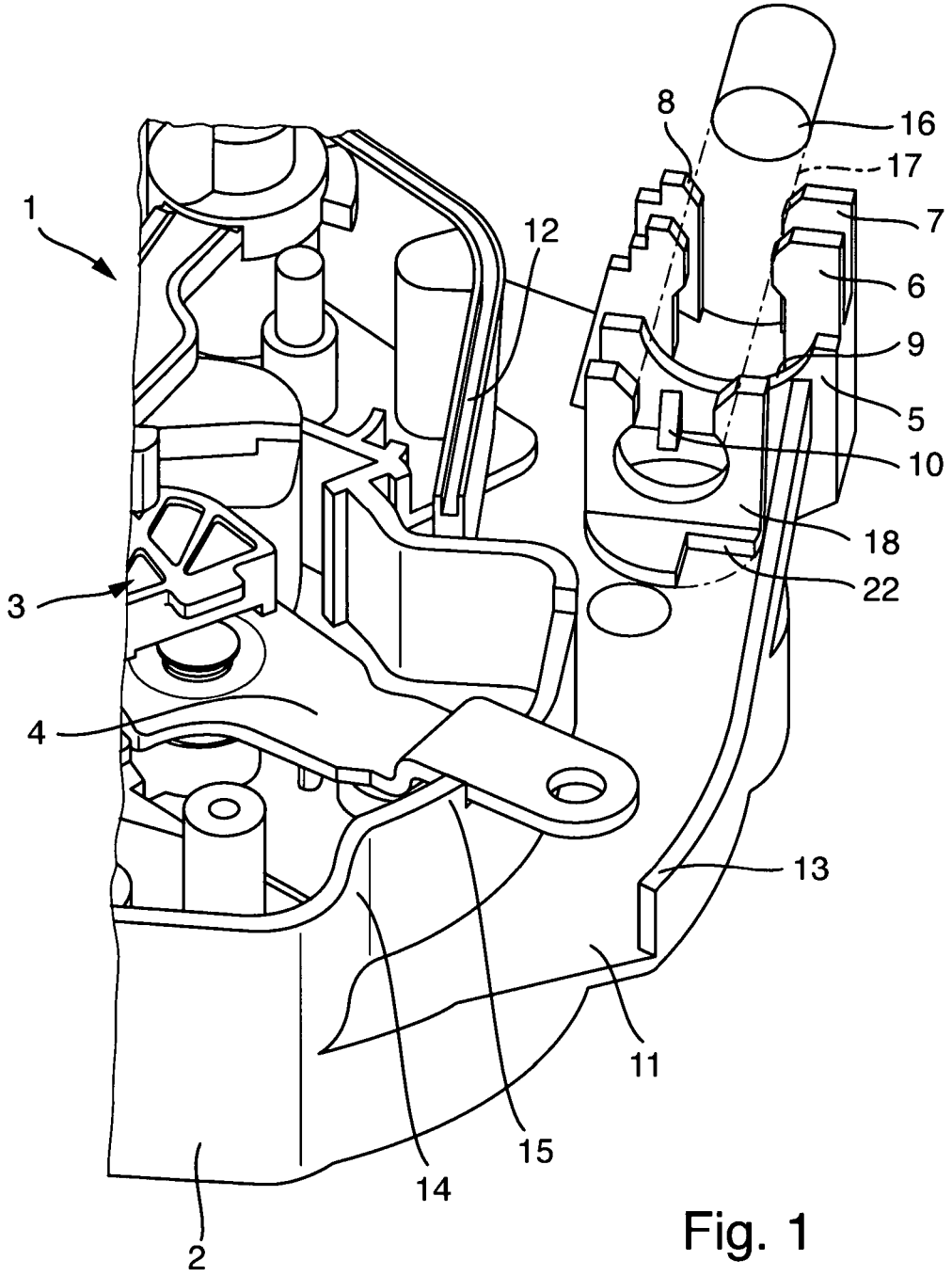
FIG. 1 shows a lock housing for a motor vehicle door latch with a closing aid and a receiving element for a Bowden cable, in which the receiving element is designed as a step mandrel.
Figure 2:
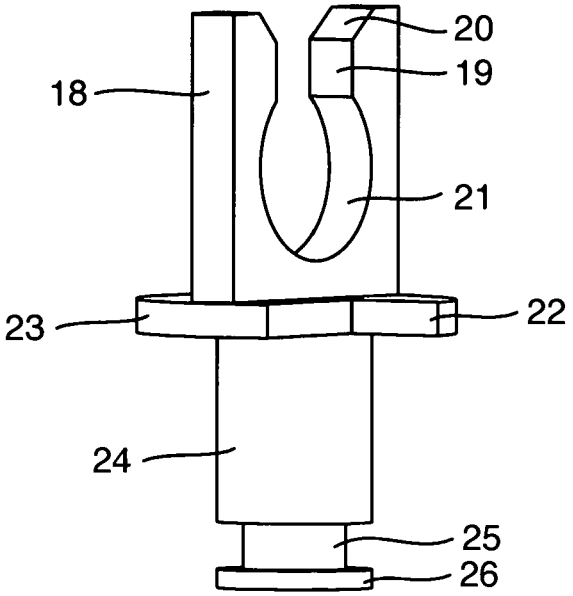
FIG. 2 represents a view of an entire step mandrel. The mandrill has been removed and is shown from the side.
Figure 3:
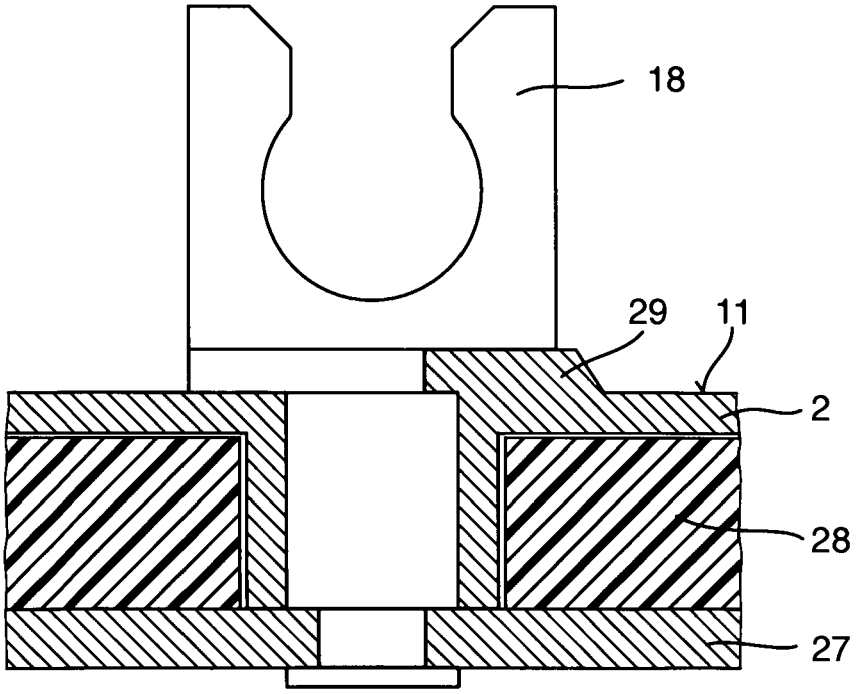
FIG. 3 shows a side view of the latch, with the step mandrel being shown from the side and in an installed state.

FIG. 1 shows a side-door latch 1 for a motor vehicle. The side-door latch is shown with an open state with only the components essential for demonstrating the invention. The side-door latch includes a lock housing 2, a locking mechanism 3 and a closing lever 4. In this embodiment, three guides 5, 6, 7 are formed on the lock housing as a single piece. The guides 6, 7 contain a tapered insertion area 8 and a receiving area 9. The guide 5 is designed as a support bearing. The guides 5, 6, 7 can also contain reinforcement ribs 10. The guides 5, 6, 7 protrude vertically or perpendicularly from a surface 11 of the lock housing 2. The surface 11 can also be formed in the area of the separating plane 12 of the lock housing parts. The figure only shows a lock housing 2 whilst a lock housing cover is not shown for reasons of representation.

The lock housing 2 contains elevations 13, 14 forming a single piece. The elevations 13, 14 can also interact with the guides, resulting in a supporting effect. The closing lever 4 protrudes through an opening 15 in an elevation 14. In this example, the opening 15 is arranged below the separating plane 12. The part of the closing lever 4 protruding out of the opening 15 is positioned above the surface 11. The closing lever 4 is arranged below the part of the locking mechanism 3 and is in contact with part of the locking mechanism 3.

The Bowden cable 16 is connected to the closing lever 5. The drawing shows the Bowden cable 16 at the top and its travel is indicated by a dotted line 17. The Bowden cable 16 starts at the top part of the drawing and continues through the centre of the guides 5, 6, 7 and the step mandrill 18 and ends at the closing lever 5. The receiving area 9 of the guides 5, 6, 7 is flush with the retaining area 21 of the step mandrill 18.

In this embodiment, the receiving element is a step mandrel 18. The step mandrel 18 is connected to the surface 11 of the lock housing 2 and protrudes from the surface 11.

The support surface 23 of the step mandrel 18 rests on the surface 11 and is circular. The step mandrel 18 contains an installation aid 22 in form of a cut-out triangular contour, integrated in the support surface 23. The installation aid is supported on a counter-contour 29. In the shown embodiment the counter-contour 29 is designed as a triangular elevation, protruding from the surface 11 of the lock housing 2.

The top section of the step mandrel contains an insertion area 19 and a retaining area 21. The top of the insertion area 19 is open and contains two level vertical walls and two beveled edges 20. The beveled edges 20 can range from between 35° to 45°. Below the insertion area the arrangement contains a retaining area 21, with a circular shape. The Bowden cable 16 is stored in the retaining area 21.

The bottom part of the step mandrel 18 consists of a base section 24, a rivet shaft 25 and a rivet head 26. The base section 24 and the rivet shaft 25 are cylindrical. In the shown embodiment the rivet head can be cylindrical. Alternatively also other rivet heads are feasible that have a semi-circular or another shape. The bottom section of the step mandrel 18 extends into the lock housing 2 and is connected to the frame box 27 on the other side of the side-door latch 1. An interim layer is arranged between the lock housing 2 and the frame box 27, said layer consisting of an overtravel buffer 28. The overtravel buffer 28 can be made from a flexible rubber.

The invention claimed is:

1. A motor vehicle latch, comprising:

a Bowden cable, a retainer for retaining the Bowden cable in the latch, the retainer comprising a base, a support surface, and a step mandrel for receiving the Bowden cable, a frame box, and a lock housing comprising a housing surface and defining a circular opening and a counter-contour, wherein the retainer is an element separate from the lock housing and from the frame box, wherein the base defines a cylindrical pin with different diameters and/or cross section areas, wherein the base extends into the circular opening, wherein the step mandrel defines a retaining area configured to retain the Bowden cable and an open insertion area above retaining area configured to allow the Bowden cable to be inserted in the retaining area and removed from the retaining area, wherein the counter-contour protrudes from the housing surface over the circular opening, and wherein the support surface abuts the housing surface and defines an installation aid that interlocks with the counter-contour.

2. The motor vehicle latch of claim 1, wherein the Bowden cable is part of a closing means.

3. The motor vehicle latch of claim 1 wherein the step mandrel protrudes away from the lock housing.

4. The motor vehicle latch of claim 1 wherein the retainer contains a support surface and the base protrudes into the lock housing.

5. The motor vehicle latch of claim 4 wherein the support surface contains an installation aid.

6. The motor vehicle latch of claim 1 wherein the retainer is connected to the frame box in a positive and/or non-positive and/or bonded manner.

7. The motor vehicle latch of claim 1 wherein the retainer is formed from a metal material.

8. The motor vehicle latch of claim 1, wherein the lock housing further comprises a surface and wherein the lock housing defines an opening that the base extends into with the step mandrel protruding away from the surface.

9. The motor vehicle latch of claim 8, wherein the step mandrel protruding away from the surface facilitates easily gripping the step mandrel during assembly.

10. The motor vehicle latch of claim 1, wherein the base extends through both the frame box and the lock housing.

11. The motor vehicle latch of claim 10, wherein the base also extends through an overtravel buffer layer.

12. The motor vehicle latch of claim 11, wherein the overtravel buffer layer is constructed from a flexible rubber.

13. The motor vehicle latch of claim 1, wherein the retainer is riveted to the frame box.

14. The motor vehicle latch of claim 1, wherein the counter-contour is a triangular elevation and the installation aid is a cut-out triangular contour.

15. The motor vehicle latch of claim 1, wherein the open insertion area is at least in part defined by two beveled walls.

16. The motor vehicle latch of claim 1, wherein the frame box and the lock housing define a blind hole that receives the base.

17. The motor vehicle latch of claim 16, wherein the counter-contour is a triangular elevation and the installation aid is a cut-out triangular contour.

18. A motor vehicle latch, comprising:

a Bowden cable, a retainer for the Bowden cable in the latch, a counter-bearing, a frame box and a lock housing comprising a housing surface, wherein the lock housing defines an opening, wherein the counter-bearing forms a further receiving element for the Bowden cable, said further receiving element being an element separate from the lock housing and from the frame box, wherein that the counter-bearing is a step mandrel containing a retaining area for receiving the Bowden cable, the step mandrel being a cylindrical pin with different diameters and/or cross section areas, wherein the step mandrel extends into the opening, wherein the retaining area defines an opening configured to retain the Bowden cable and an open insertion area above the opening configured to allow the Bowden cable to be inserted in the retaining area;

a support surface on the step mandrel that abuts the housing surface;

wherein the lock housing further defines a counter-contour that protrudes from the housing surface over the opening; and wherein the support surface defines an installation aid that interlocks with the counter-contour.

* * * * *